United States Patent [19]

Rochman

[11] 4,250,694

[45] Feb. 17, 1981

[54] ARRANGEMENT FOR OPENING PLASTIC BAGS IN AUTOMATIC PACKAGING MACHINES

[76] Inventor: Tzur Rochman, 35 Hachashmonaim St., Tel-Aviv, Israel

[21] Appl. No.: 46,203

[22] Filed: Jun. 6, 1979

[51] Int. Cl.[3] ..... B65B 43/36

[52] U.S. Cl. ..... 53/572; 53/385

[58] Field of Search ..... 53/572, 573, 384, 385

[56] References Cited

U.S. PATENT DOCUMENTS

| | | | |
|---|---|---|---|
| 2,307,990 | 1/1943 | Briggs | 53/384 |
| 3,468,100 | 9/1969 | Rubel | 53/572 |
| 3,727,374 | 4/1973 | Williams | 53/572 |
| 3,783,580 | 1/1974 | Raudys | 53/572 X |
| 4,172,349 | 10/1979 | Lipes | 53/572 X |

*Primary Examiner*—Travis S. McGehee

*Attorney, Agent, or Firm*—Charles W. Helzer

[57] ABSTRACT

The invention relates to an arrangement for opening plastic bags and retaining same in open position during the operation of automatic packaging machines. It comprises a hopper, funnel or the like, a source for an air jet which blows air into the opened bag through an air nozzle, a stack of bags stored vertically and below the product supply and a hoop of semicircular cross-section made of wire, strip of metal or plastic adapted to engage said opened bag and being rotatably mounted in a supporting mechanism adjacent to the supply of said bag.

8 Claims, 4 Drawing Figures

Fig. 1
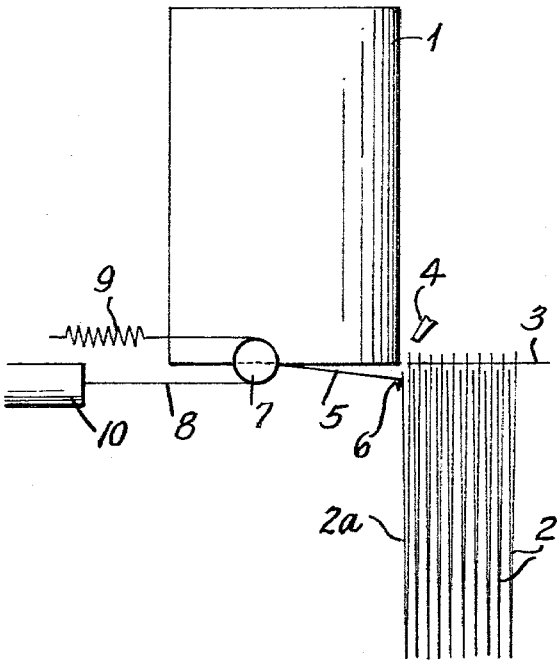
Fig. 3
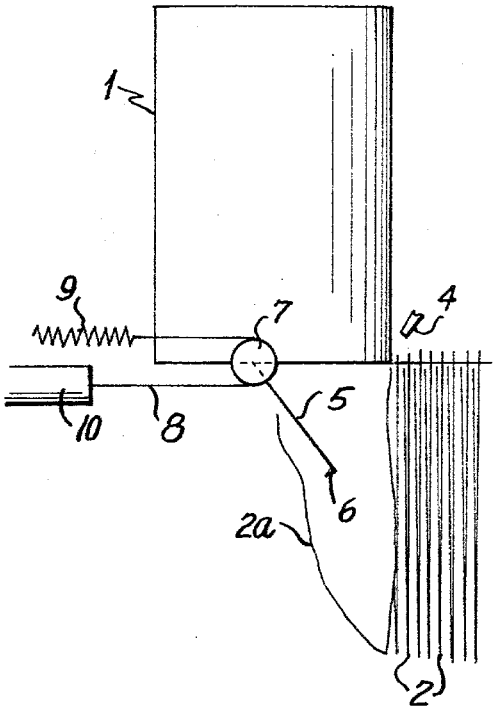
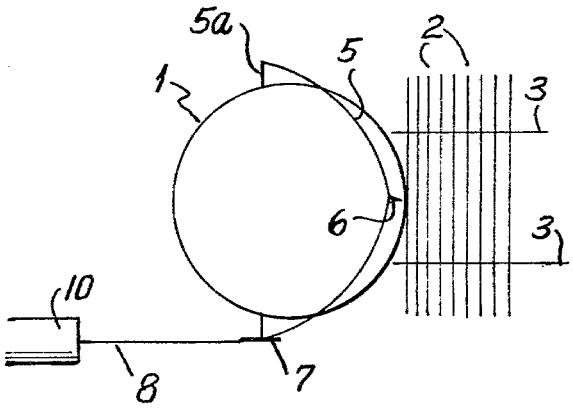
Fig. 2
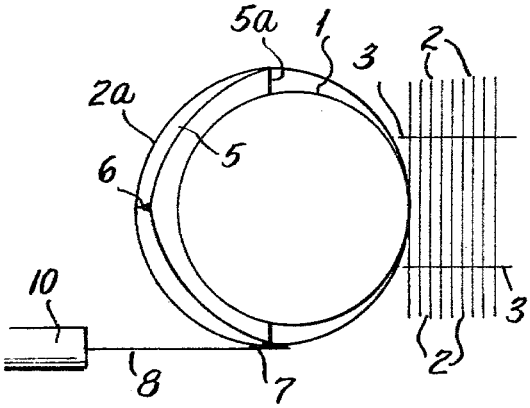
Fig. 4

ARRANGEMENT FOR OPENING PLASTIC BAGS IN AUTOMATIC PACKAGING MACHINES

DESCRIPTION OF PRIOR ART

In an automatic packaging machine a supply of plastic bags is generally held in vertical position on two pins or the like and one side of said plastic bags is longer than the other for this purpose. This supply of bags is generally mounted below or adjacent the hopper, funnel or the like. An air nozzle is mounted so as to inflate the uppermost bag at the moment just before the goods are allowed to drop into this bag.

Many kinds of holding arrangements are provided for holding the bag in open position while it is being filled. All the known arrangements for holding the bag in open position, such as flaps, levers and the like, have the disadvantage that they just open the bag but do not retain it with a fully circular opening. This often interferes with proper packaging of circular goods. Furthermore, some of these arrangements take up vertical space in the bag which otherwise could be utilized by the goods themselves. Thus the bag must be longer than the size of the goods would require. This causes a waste of material. Furthermore the flaps or the like can not be rotated generally more than 90° and thus will always extend deep into the open bag.

SHORT DESCRIPTION OF THE INVENTION

It is therefore an object of the present invention to provide an arrangement whereby the above listed disadvantages are overcome and the bag is opened substantially with a cylindrical opening in a manner which does not interfere with the goods to be packaged.

The invention consists in an arrangement for opening plastic bags automatically and retaining them in open position, wherein the bags are stored vertically adjacent and below the product supply with the uppermost bag being opened by an air jet. The invention is further characterized by a substantially semicircular hoop having an outwardly extending thorn substantially in its center mounted so as to be rotatable downwardly around a horizontal axis by substantially 180° below said supply means for holding bags in an open position.

After a bag has been slightly opened by said air jet as known, the said hoop is rotated whereby its thorn engages the unattached wall of the bag from the inside and lifts it, said bag applying itself against said hoop and thus assuming a substantially circular cross section.

DETAILED DESCRIPTION OF THE INVENTION

The invention is illustrated, by way of example only, in the accompanying drawings in which:

FIG. 1 is a schematic elevational view of the arrangement for opening plastic bags and retaining the bags in open position according to the invention, in the position of rest.

FIG. 2 is a schematic top plan view thereof.

FIG. 3 is a view similar to FIG. 1 as the bag is being opened.

FIG. 4 is a schematic view similar to that of FIG. 2 with the bag in the open position.

Referring to FIG. 1, in automatic packaging machines a hopper, funnel or the like 1 is vertically arranged through which the product to be packaged is supplied. The plastic bags 2, having one edge longer than the other, are held in vertical position by posts 3 which extend through said longer edge as known. An air nozzle or air jet 4 is mounted above the supply of bags 2 and points towards the outermost bag 2*a* to inflate it. All this is known per se and does not form part of the invention.

According to the invention a hoop 5 of substantially semicircular cross section of wire-strip material of metal, plastic or the like is mounted at the bottom in the wall of hopper 1 in that its ends a bend to form gudgeon pins 5*a* which are rotatable in eyelets, bearings (not shown) or the like mounted in said hopper in a vertical plane slightly excentric to the central plane of the hopper. Substantially in the center of hoop 5 an outwardly extending thorn 6 is provided. Coaxial with the gudgeon pin 5*a* a ratchet wheel 7 is mounted to an extension of said gudgeon pin on one side of said hopper, a cable, chain or the like 8 being wound around said wheel 7 and being held at one end by a spring 9 and at the other by a piston 10.

The arrangement works as follows:

After the air jet 4 inflates the innermost bag 2*a*, a signal is given to piston 10 whereby chain 8 and thereby wheel 7 is rotated causing the downward rotation of hoop 5 within bag 2*a* as shown in FIG. 3. As the hoop continues in its upward rotation, thorn 6 engages the inermost wall of bag 2*a* from the inside pulling it upwardly so that it is applied against the hoop 5 and the bag assumes an opening of substantially circular cross section since its opposite wall will be applied against hopper 1. After said bag is filled and removed in any known manner from post 3 and hoop 5, an operation which may also occur by the force of gravity owing to the weight of the product within the bag, the control acts so that spring 9 can return cable 8, wheel 7 and thus hoop 5 into its original position shown in FIG. 1.

Many variations of the construction of the arrangement are possible within the scope of the present invention. Thus, the hoop 5 can be rotatingly mounted in any supporting mechanism adjacent the supply of bags 2 other than hopper 1. The rotating and return mechanism of hoop 5 may comprise, instead of wheel 7, chain 8, spring 9 and piston 10, a link arrangement, hydraulic or pneumatic pistons, cable means or the like.

In the example shown herein a piston may replace spring 9. Instead of one thorn 6, a number of integral thorns spaced along the hoop may be provided.

It can be seen that owing to the fact that hoop 5 is rotated substantially through 180° and is of semicircular shape, it will only be applied against the top edge of the bag 2*a* so that it does not extend deep within it and does not interfere with the product to be packaged therein.

In an alternative embodiment of the invention the hoop may not be equipped with the thorn 6. In this case it engages the inside of the bag itself and can rotate through 360° when the bag has reached its uppermost position, thereby returning to its original position.

I claim:

1. An arrangement for opening a stack of bags and retaining each bag in fully open position until goods are allowed to drop into said bag, said arrangement comprising funnel means for the supply of goods to be bagged, an air jet source comprising an air nozzle, a stack of bags stored vertically and below the goods supply with the outer lip of the outermost bag in the stack projected under the air nozzle, a hoop of generally semicircular configuration pivotally mounted in a supporting mechanism adjacent to the bottom of the funnel means and supply of said bags, means for pivoting the hoop through substantially 180° to grasp and open the outermost bag fully under the funnel means after partial opening of the outermost bag has been initiated by said air nozzle, and return means for bringing said hoop back into its starting position after filling of the bag.

2. An arrangement for opening a stack of bags and retaining each bag in fully open position until goods are allowed to drop into said bag as claimed in claim 1, wherein the mounting of said hoop is in the wall of said funnel means at the bottom.

3. An arrangement for opening a stack of bags and retaining each bag in fully open position until goods are allowed to drop into said bag as claimed in claim 1, wherein said hoop has an outwardly extending thorn formed on the outer side thereof substantially in its centre and adapted to engage the inner wall of the partially open outermost bag.

4. An arrangement for opening a stack of bags and retaining each bag in fully open position until the goods are allowed to drop into said bag according to claim 3, wherein said means for pivoting is adapted to make said hoop rotatable downwardly through a 180° arc around a horizontal axis below the outlet of said funnel means during which the outwardly extending thorn on said hoop engages and fully opens the outermost bag.

5. An arrangement for opening a stack of bags and retaining each bag in fully open position until the goods are allowed to drop into said bag according to claim 1, wherein said hoop engages the inside of said partially open bag to fully open the bag and said return means rotates the hoop through 360° back to its starting position after said open bag has been filled to a sufficient extent.

6. An arrangement as claimed in any of claims 1 to 5, wherein the means for pivoting and return means for said hoop comprises a wheel connected to the hoop, a chain driving the wheel, a return spring connected to one end of the chain and a piston connected to and driving the remaining end of the chain.

7. An arrangement as claimed in any of claims 1 to 5, wherein the means for pivoting and the return means for said hoop comprises hydraulic or pneumatic pistons connected to a cable means for driving a wheel that rotates the hoop.

8. An arrangement as claimed in claim 3, wherein a number of integral thorns spaced along the outer side of said hoop are provided.

* * * * *